US005373588A

United States Patent [19]

Hede et al.

[11] Patent Number: 5,373,588

[45] Date of Patent: Dec. 20, 1994

[54] SAFETY HELMET WITH ADJUSTMENT OF THE DEVICE FOR SECURING IT ON THE HEAD

[75] Inventors: Jean Marc Hede, La Tronche; Alain Maurice, Giéres, both of France

[73] Assignee: Zedel, Crolles, France

[21] Appl. No.: 19,624

[22] Filed: Feb. 18, 1993

[30] Foreign Application Priority Data

Feb. 27, 1992 [FR] France ..... 9202432

[51] Int. Cl.[5] ..... A42B 1/22

[52] U.S. Cl. ..... 2/418

[58] Field of Search ..... 2/410, 416, 417, 418, 2/419, 420, 183, 197, 8; 24/68 R, 68 B, 68 SK

[56] References Cited

U.S. PATENT DOCUMENTS

| | | | |
|---|---|---|---|
| 2,205,741 | 6/1940 | Bowers . | |
| 2,205,742 | 6/1940 | Bowers | 24/68 B |
| 2,926,406 | 3/1960 | Edwards et al. | 24/68 B |
| 3,137,859 | 6/1964 | Zbikowski | 2/418 |
| 3,214,809 | 11/1965 | Edwards | 24/68 B |
| 3,329,968 | 7/1967 | Gordon . | |
| 3,387,304 | 6/1968 | Simpson et al. . | |
| 3,500,474 | 3/1970 | Austin | 2/418 |
| 4,000,520 | 1/1977 | Svendsen et al. . | |
| 4,263,679 | 4/1981 | Erlendson | 2/420 |
| 4,292,692 | 10/1981 | Moretti et al. | 2/418 |
| 4,888,831 | 12/1989 | Oleson . | |
| 4,999,846 | 3/1991 | Ball et al. . | |

FOREIGN PATENT DOCUMENTS

| | | | |
|---|---|---|---|
| 218753 | 12/1961 | Austria | 2/420 |
| 1347858 | of 1964 | France . | |
| 106865 | 11/1899 | Germany . | |

*Primary Examiner*—Clifford D. Crowder
*Assistant Examiner*—Michael A. Neas
*Attorney, Agent, or Firm*—Stevens, Davis, Miller & Mosher

[57] ABSTRACT

A safety helmet with a crown comprises a head-band with a strip adjustable by means of a first mechanism with inverter pinion cooperating with a first crown-wheel and a second crown-wheel located at the two opposite ends of the strip. An operating ring is accessible from outside to perform adjustment with one hand when the helmet is on the user's head. The double crown-wheel is arranged on the side of the crown and enables perfect centering to be achieved regardless of the size of the head-band.

Application: potholing, mountaineering, construction sites, etc.

8 Claims, 10 Drawing Sheets

SAFETY HELMET WITH ADJUSTMENT OF THE DEVICE FOR SECURING IT ON THE HEAD

BACKGROUND OF THE INVENTION

The invention relates to a safety helmet with a crown made of material resistant to mechanical shocks, containing a lining cap separated from the peak of the crown by an insulating gap, a securing device having a head-band with a flexible annular strip arranged away from the edge of the crown to grip the circumference of the user's head, and means for adjusting the length of the head-band comprising:

- a first mechanism with operating inverter pinion cooperating simultaneously with a first crown-wheel and a second crown-wheel located respectively at the two opposite ends of the strip,

- a first operating device accessible from outside and able to be grasped in the fitted position of the helmet on the user's head, said operating device being in mechanical connection with the inverter pinion, and being formed by a rotating ring comprising a spindle on which the inverter pinion is mounted, which is arranged to transform the rotation movement of the ring into two reverse sliding movements of the two crown-wheels resulting in an increase or decrease of the length of the head-band depending on the direction of rotation of the ring.

State-of-the-art means for adjusting the head-band make use of a loop fixed to one of the ends of the band or strap, and designed to cooperate with the other free end. The loop is located inside the crown and adjustment of the head-band requires the helmet to be taken off and both hands to be used. Several operations are generally necessary before the correct adjustment is found. Another drawback of the adjusting loop results from the decentering effect of the head-band with respect to the mid-axis of the crown, generated when a variation of the useful length of the annular band is made. These drawbacks are detrimental to the speed of adjustment, and convenience of use.

Adjustment of the head-band by means of an inverter pinion and double crown-wheel mechanism is already known from the documents U.S. Pat. No. - A 3,329,968 and U.S. Pat. No. - A 4,888,831. The mechanism is however located at the rear of the crown, resulting in permanent engagement of the head against the front part of the crown. Axial centering of the head with respect to the vertical mid-axis of the helmet is not ensured.

The object of the invention consists in improving adjustment of the securing device when the helmet is fitted on the user's head.

SUMMARY OF THE INVENTION

The safety helmet according to the invention is characterized in that the first adjustment mechanism and the two ends of the head-band are located on one of the sides of the crown, preferably in the middle zone, and that the toothing of the two crown-wheels is identical to preserve centering of the front and rear parts of the head-band when adjustment is performed by the first mechanism.

Centering of the head with respect to the vertical mid-axis of the helmet is preserved, regardless of the size of the user's head, by means of the double crown-wheel structure, and the lateral positioning of the adjustment mechanism on one of the sides of the crown.

The securing device in addition comprises a neck-band with retaining strap having a fixed end, and an opposite end equipped with a third crown-wheel cooperating with a pinion of a second adjustment mechanism associated with a second operating device.

The first and second adjustment mechanisms are arranged in a first and second spaces on the two opposite sides near the mid-zone of the crown.

BRIEF DESCRIPTION OF THE DRAWINGS

Other advantages and features will become more clearly apparent from the following description of two illustrative embodiments of the invention, given as non-restrictive examples only and represented in the accompanying drawings in which.

DESCRIPTION OF THE PREFERRED EMBODIMENT

Figure 1:
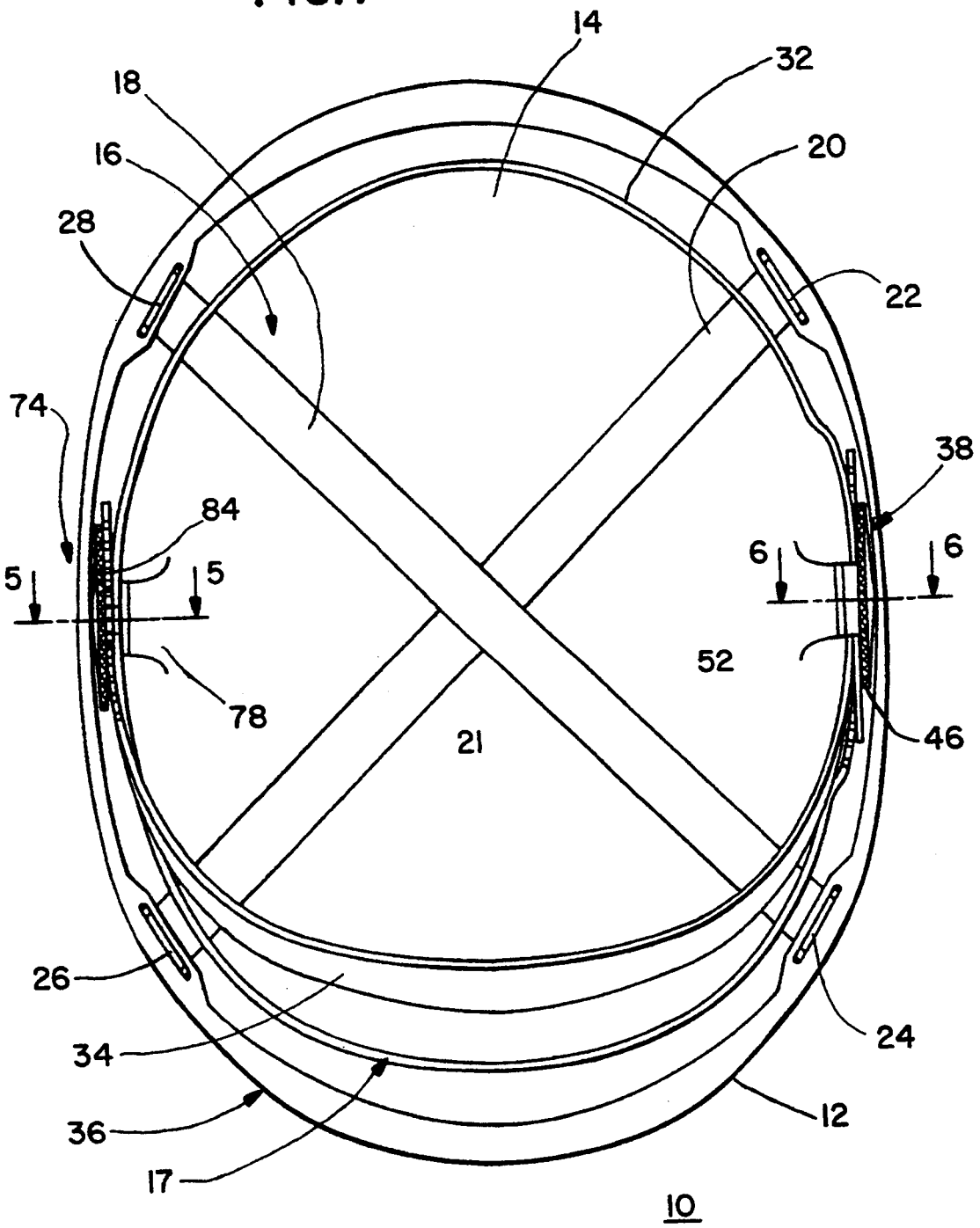
FIG. 1 is an elevational view of the inside of the helmet according to the invention.

In FIGS. 1 to 6, a safety helmet 10 comprises a crown 12 made of material resistant to mechanical shocks, and bounding an internal volume 14 equipped with a lining cap 16, and a securing device 17 adaptable to the user's head. The lining cap 16 is formed by a cross-piece of two webbing straps 18, 20, stitched together in the central intersection zone 21, and attached by their ends to four attachment points 22, 24, 26, 28, staggered at predetermined intervals along the edge 30 of the crown 12. The lining cap 16 covers the top of the head, and is separated from the internal wall of the crown 12 by an insulating gap (not represented) preventing any transmission of mechanical stresses to the head in the event of an external shock suffered by the crown 12.

The securing device 17 of the helmet 10 comprises an internal head-band 32 designed to grip round the circumference of the user's head, and a neck-band 34 with retaining strap mounted overlapping towards the rear part 36 of the helmet 10.

The head-band 32 is made from a flexible strip shaped as a closed ring, arranged away from the edge 30 and following the internal configuration of the base of the crown 12. Adjustment of the circumference of the head-band 32 is performed by means of a first adjustment mechanism 38, comprising an inverter pinion 40 engaging with a first and second crown-wheel 42, 44 arranged at the two narrow ends 43, 45 of the band. The toothed pinion 40 forms an integral part of a first operating ring 46 securedly united to a spindle 48 mounted with rotation in an orifice 50 of a first fixed flange 52.

The first flange 52 is separated from the internal wall of the crown 12 by a first lateral space 54 housing the first adjustment mechanism 38. The flange 52 is securedly united to the internal wall of the crown 12 at a first fixing point 56, and is advantageously cast with the crown 12, made of plastic material. The spindle 48 extends appreciably perpendicularly to the wall of the crown 12, and the ring 46 and pinion 40 assembly is mounted coaxially on the spindle 48.

The two flat narrow ends 43, 45 of the head-band 32 are arranged edgewise in the same plane perpendicular to the spindle 48 of the operating ring 46, resulting in the two crown-wheels 42, 44 being opposite one another with the inverter pinion 40 located between them. A guide cage 58 is mounted coaxially on the spindle 48 to maintain the positioning of the two crown-wheels 42, 44 on the teeth of the pinion 40.

The association of the pinion 40 with the two crown-wheels 42, 44 is in the same plane located between the operating ring 46 and guide cage 58. The toothing of the first crown-wheel 42 is oriented towards the base of the crown 12, and forms part of the end 43 of the rear part of the head-band 32. The toothing of the second crown-wheel 44 is oriented towards the inside of the helmet 10, and forms part of the other end 45 associated with the front part of the head-band 32. The width of each end 43, 45 is appreciably identical, and is less than half of the total width of the band. The gap between the two crown-wheels 42, 44 corresponds appreciably to the external diameter of the pinion 40.

The front part of the head-band 32 is equipped with a flexible attachment 60 provided with two parallel oblong slits 62, 64, one 62 of which can be clipped onto a securing stud 66 fixed to the internal wall of the crown 12. Another flexible attachment (not represented) of identical structure is arranged opposite the attachment 60, on the rear part of the head-band 32.

The first adjustment mechanism 38 and the two ends 43, 45 of the head-band 32 are located on one of the lateral sides of the crown 12, preferably in the middle zone between the two opposing attachments 60. The operating ring 46 protrudes slightly out from the edge 30 of the crown 12 to make it easier to grasp when the head-band 32 is to be adjusted.

Operation of the first adjustment mechanism 38 of the head-band 32 is as follows:

After the helmet 10 has been placed on the head, adjustment of the head-band 32 can be performed by the user with one hand, by turning the operating ring 46 in a given direction. The pinion 40 transmits the rotation movement of the ring 46 to the two crown-wheels 42, 44, causing a sliding movement in reverse directions of the corresponding ends 43, 45 of the head-band 32. This results in a decrease or an increase of the circumference of the band depending on the direction in which the rotating ring 46 is actuated.

Figure 3:
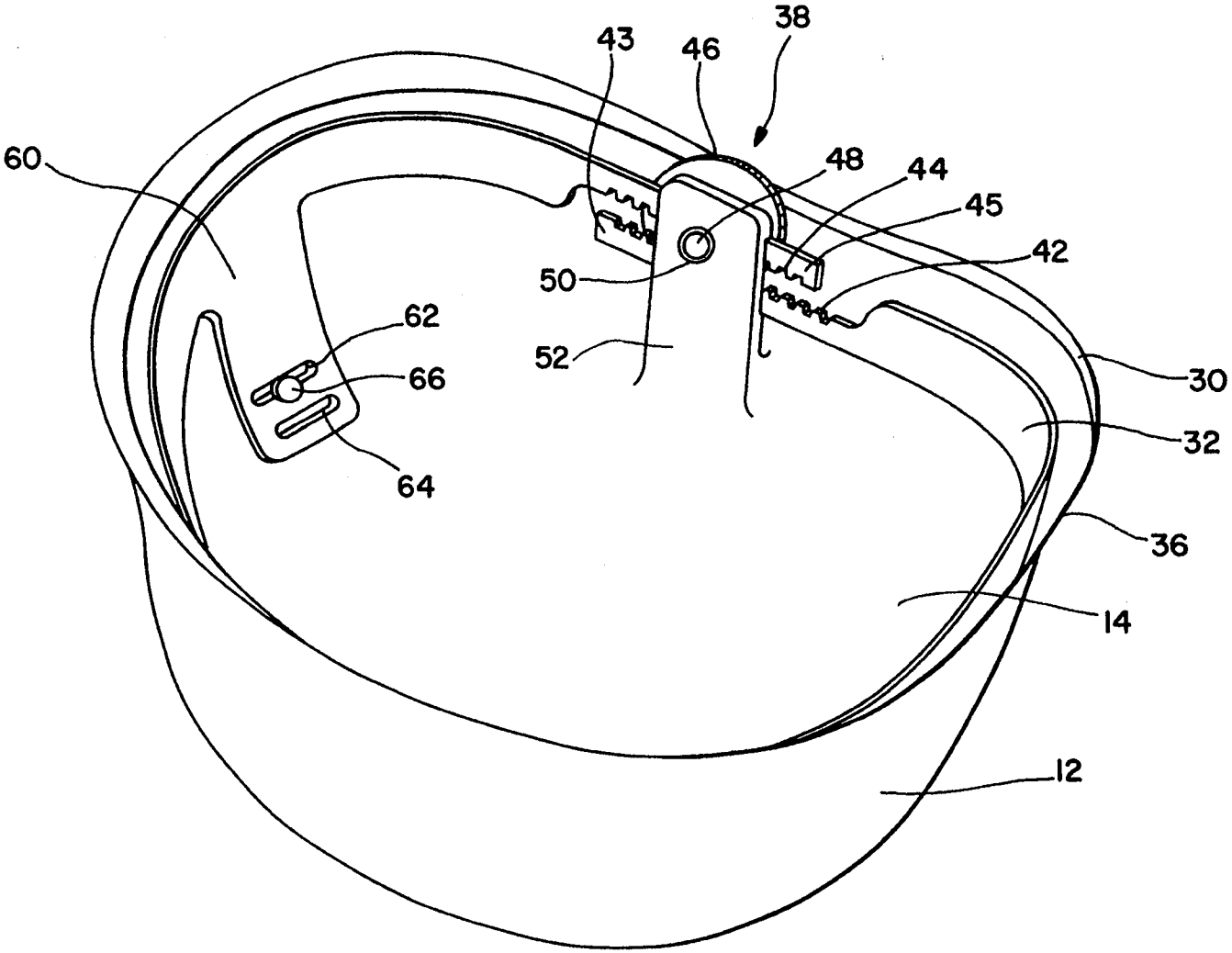
Figure 4:
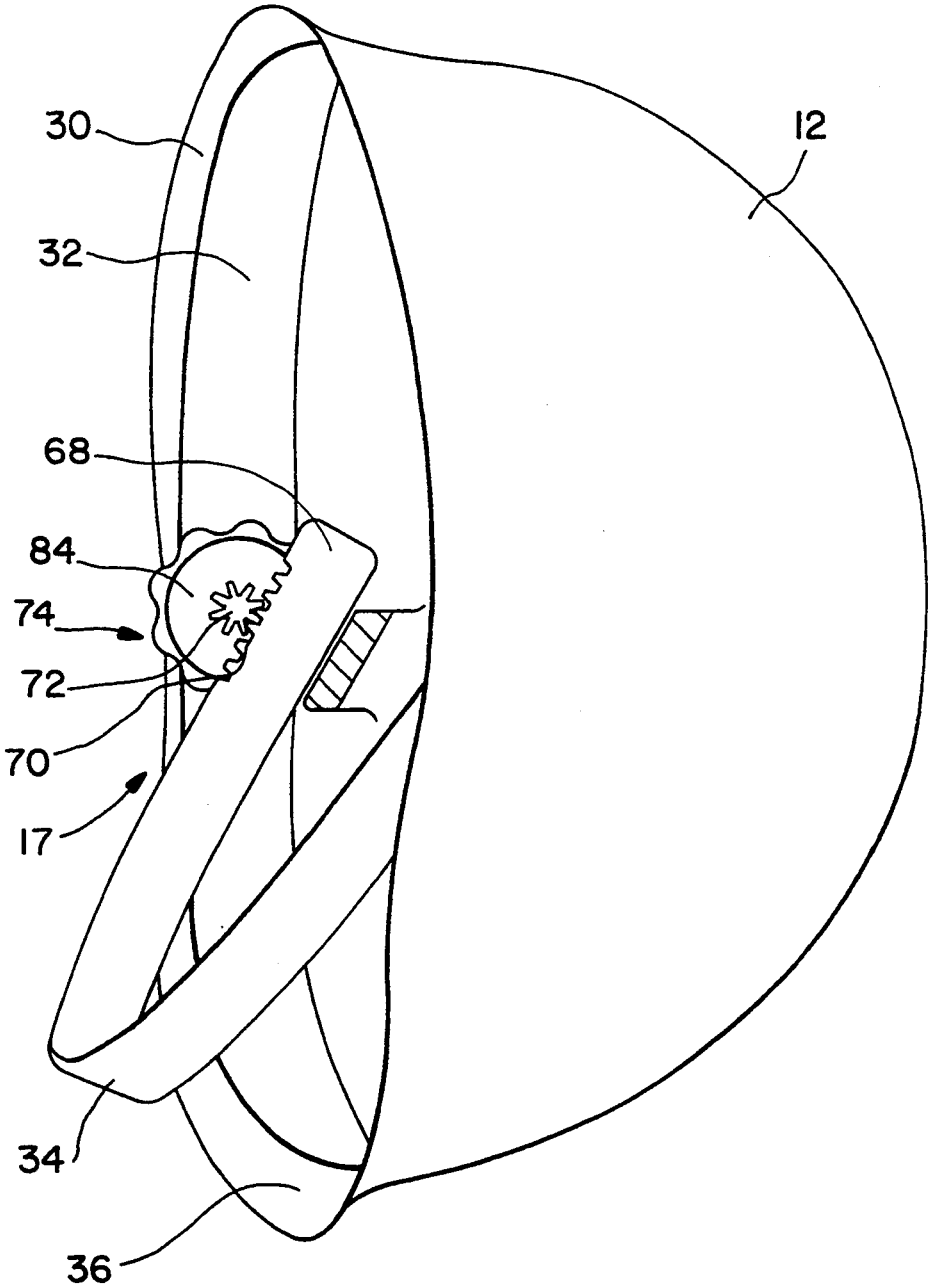
FIG. 4 represents another perspective view of the helmet, equipped with the second adjustment mechanism of the neck-band.
Figure 5:
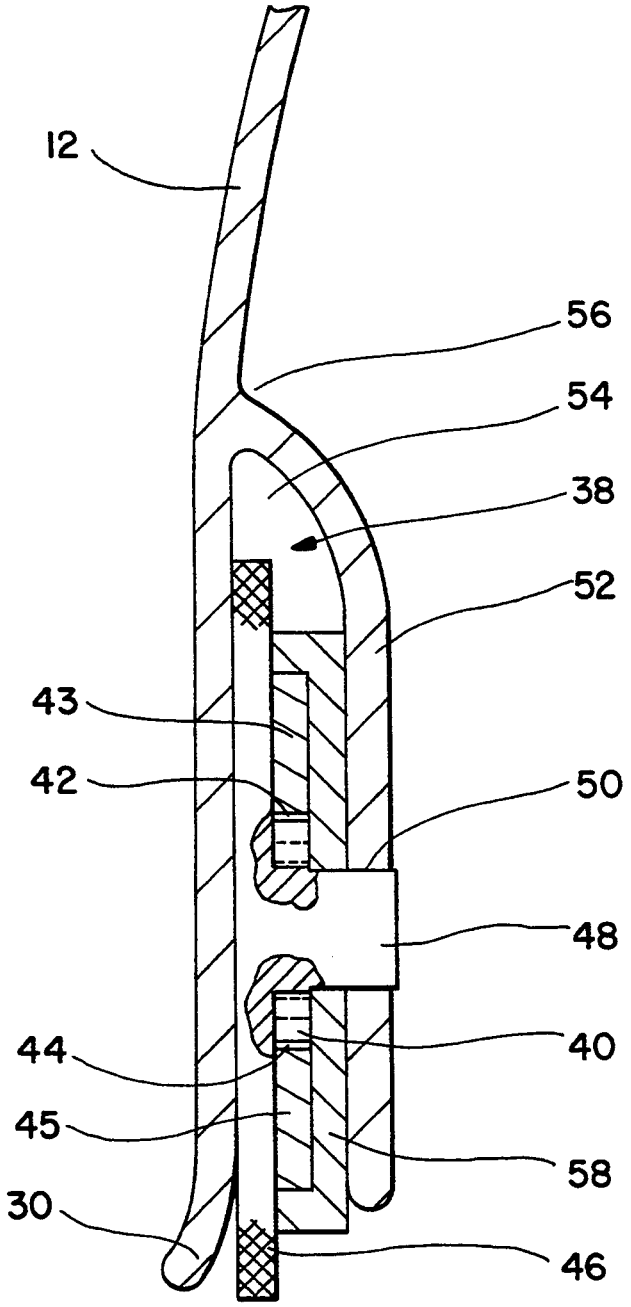
FIGS. 5 and 6 are cross-sectional views respectively along the lines 5—5 and 6—6 of FIG. 1.
Figure 6:
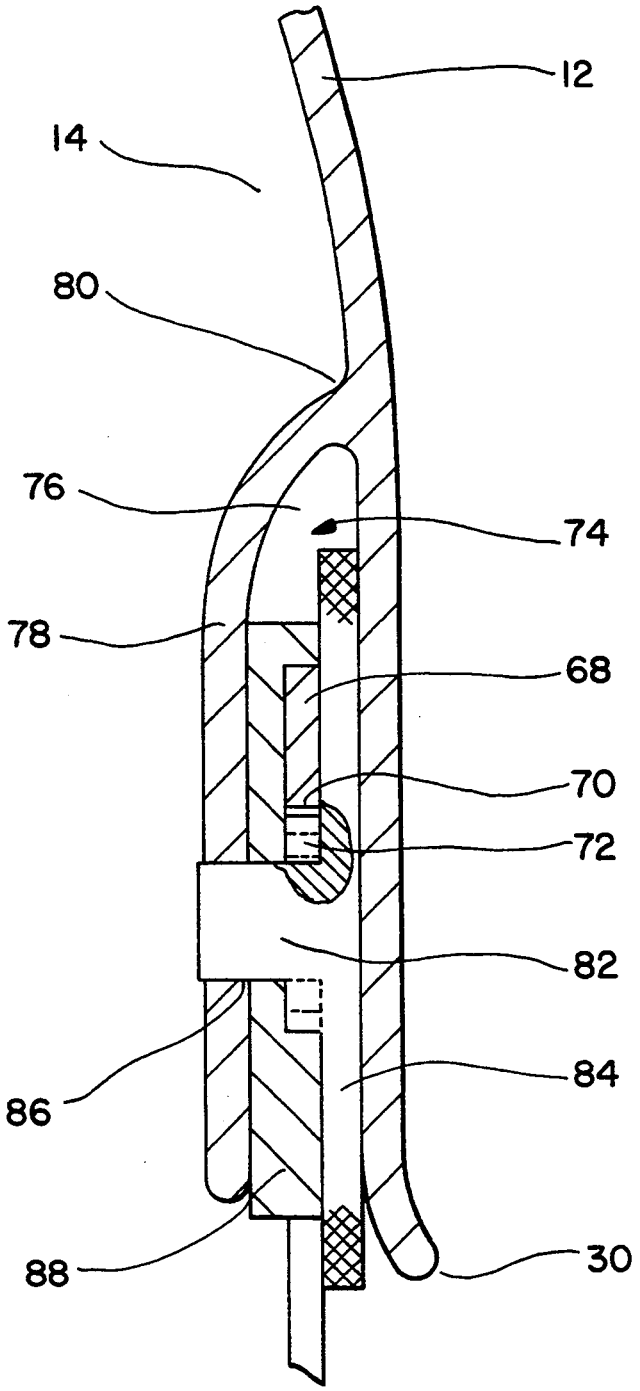

The travels of the two ends 43, 45 of the head-band 32 are identical being determined by the radius of the inverter pinion 40 transforming the rotation movement of the ring 46 into a sliding movement. The presence of the inverter pinion 40 associated with the double crown-wheel 42, 44 enables centering of the front and rear parts of the band to be preserved, regardless of the size of the head-band 32. The elasticity of the two attachments 60 follows the movement of bringing the front and rear parts of the band together when the ring 46 is adjusted, while maintaining the head-band at a predetermined level, slightly away from the edge 30 of the crown 12. In FIG. 3, the slit 62 cooperates with the securing stud 66. The headband 32 can be moved towards the edge 30 by using the other adjacent slit 64.

One of the ends (on the right in FIG. 1) of the strap of the neck-band 34 is fixed, being securedly united for example to the first flange 52. The opposite end 68 (the one on the left in FIG. 1) of the neck-band 34 is equipped with a third crown-wheel 70 cooperating with a pinion 72 of a second adjustment mechanism 74, shown in detail in FIGS. 4 to 6.

Inside the volume 14, the second mechanism 74 is housed in a second space 76 bounded by a second flange 78, which is securedly united to the internal wall of the crown 12 at a second fixing point 80. The pinion 72 is mounted coaxially on a spindle 82 of a second operating ring 84. The spindle 82 is inserted with a slight clearance in an orifice 86 of the second flange 78, and is appreciably in alignment with the other spindle 48 of the first adjustment mechanism 38.

A guide part 88 securedly united to the head-band 32 is housed in the second space 76 in contact with the flange 78, and ensures the coplanar positioning of the third crown-wheel 70 with respect to the pinion 72. The assembly formed by the crown-wheel 70 and pinion 72 is disposed in a plane perpendicular to the spindle 82, being inserted between the guide part 88 and the second operating ring 84.

Clockwise rotation of the second operating ring 84 (in FIG. 4) causes sliding of the end 68 to the right, corresponding to an increase of the useful length of the neck-band 34. To perform progressive tightening of the neck-band 34 in the course of use of the helmet 10, the second ring 84 merely has to be turned counterclockwise.

The two adjustments of the head-band 32 and neck-band 34 are made in the fitted position of the helmet 10 and enable a perfect adjustment to be obtained. The two adjustment mechanisms 38, 74 are arranged on the two opposite sides in the mid-zone of the crown 12. Adjustment of the head-band 32 is performed by user's left hand, and that of the neck-band 34 by his right hand. It is not necessary to remove the helmet 10 to perform these adjustments, and centering of the head-band 32 is preserved in the internal volume of the crown 12.

The crown-wheels 42, 44, 70 can be distinct parts fitted at the corresponding ends 43, 45, 68 of the head-band 32 and neck-band 34.

The crown-wheels 42, 44, 70 can be achieved directly by overcasting of the webbing straps.

According to an alternative embodiment (not represented), the double crown-wheel 42, 44 and inverter pinion 40 system of the first mechanism 38 can be replaced by two independent adjustment devices associated with the front part and with the rear part of the head-band 32, each of the devices comprising a pinion and a single crown-wheel. The crown 12 of the helmet can be made of plastic or metallic material.

Figure 7:
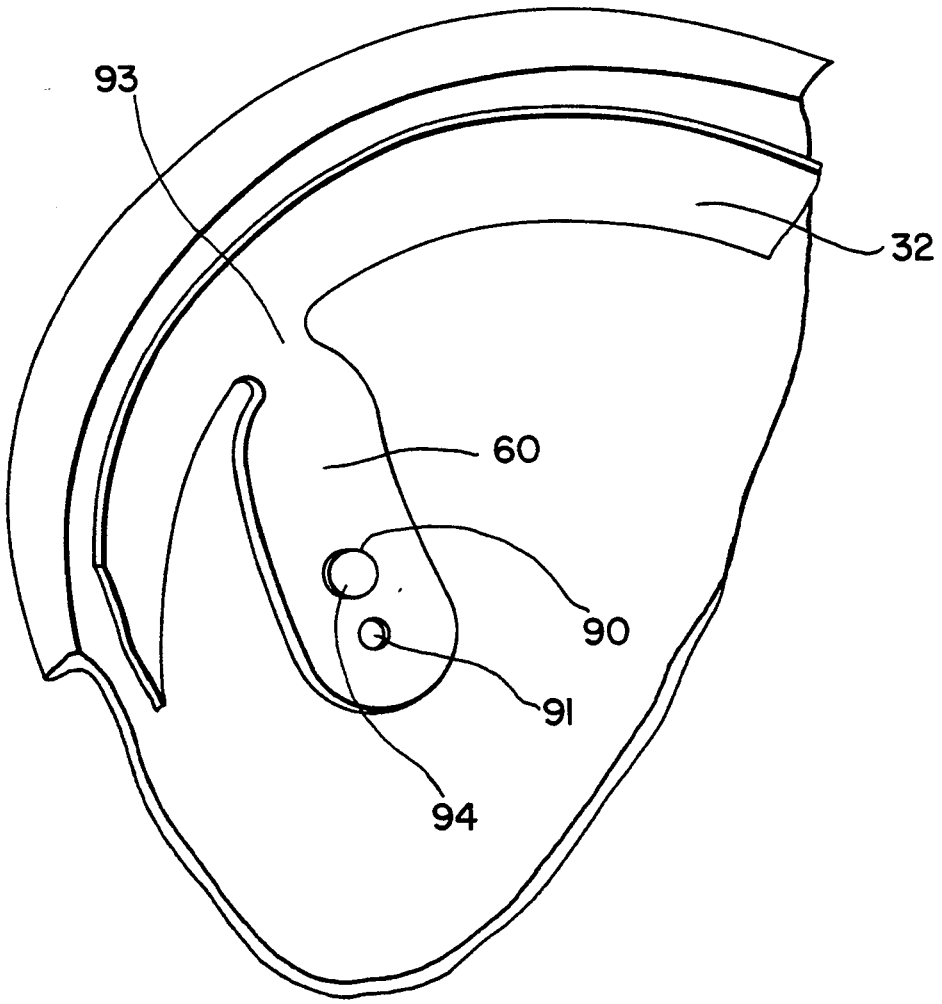
FIG. 7 is a similar view to FIG. 3 of an alternative embodiment.

According to an alternative embodiment in FIG. 7, the attachment 60 comprises a first flexible part 93 of narrow cross-section, and a second larger part provided with two holes 90, 91 either one of which is clipped onto a securing stud 94 of the crown according to the required height of the head-band 32.

Figure 2:
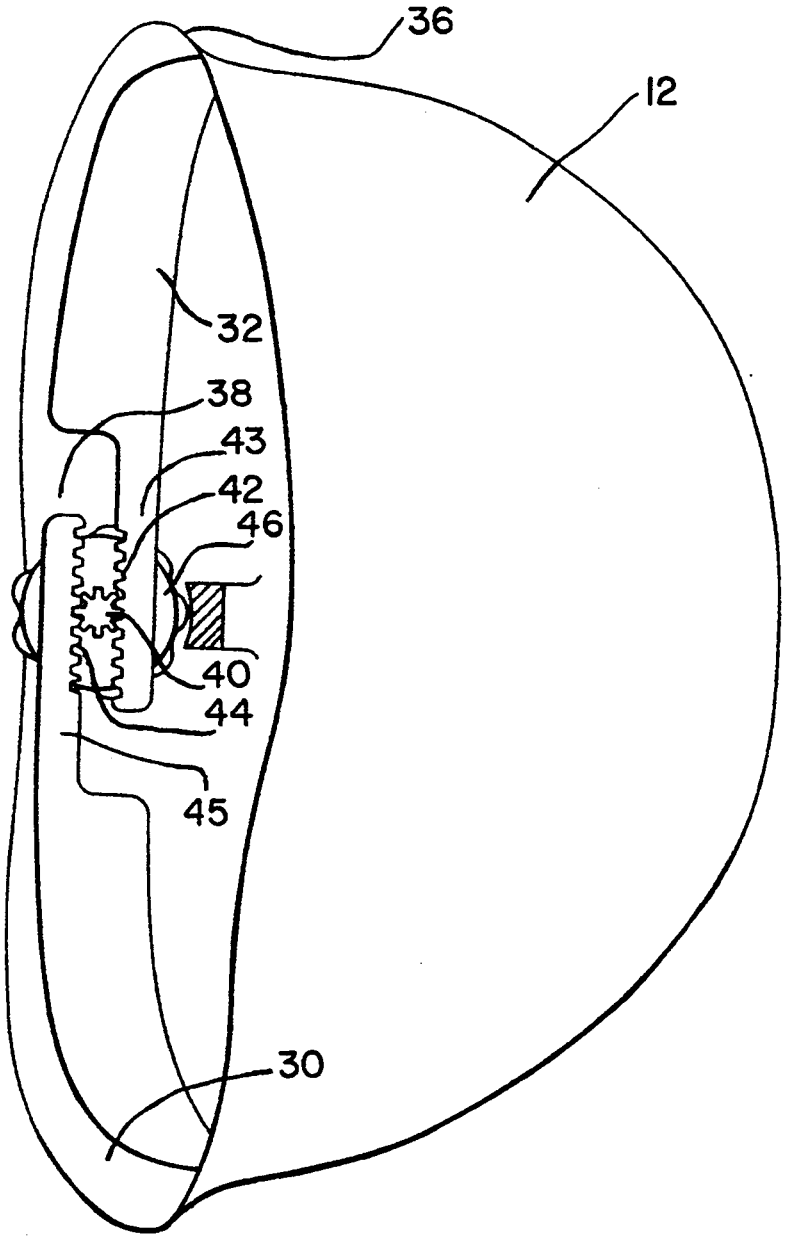
FIGS. 2 and 3 show two perspective views of the helmet, equipped with the first adjustment mechanism of the head-band.
Figure 8:
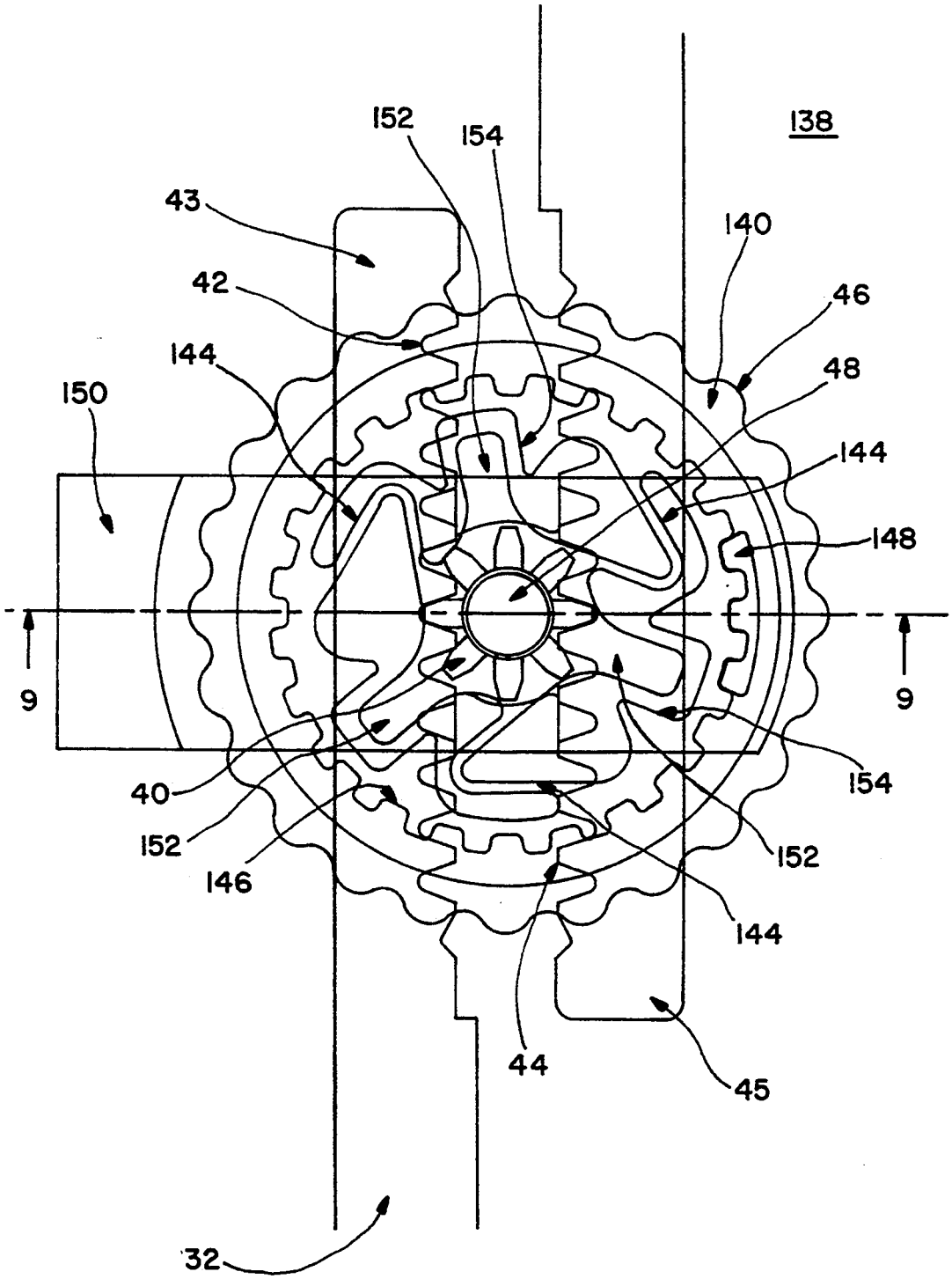
FIG. 8 shows an improvement of the adjustment mechanism represented in the locked position.
Figure 9:
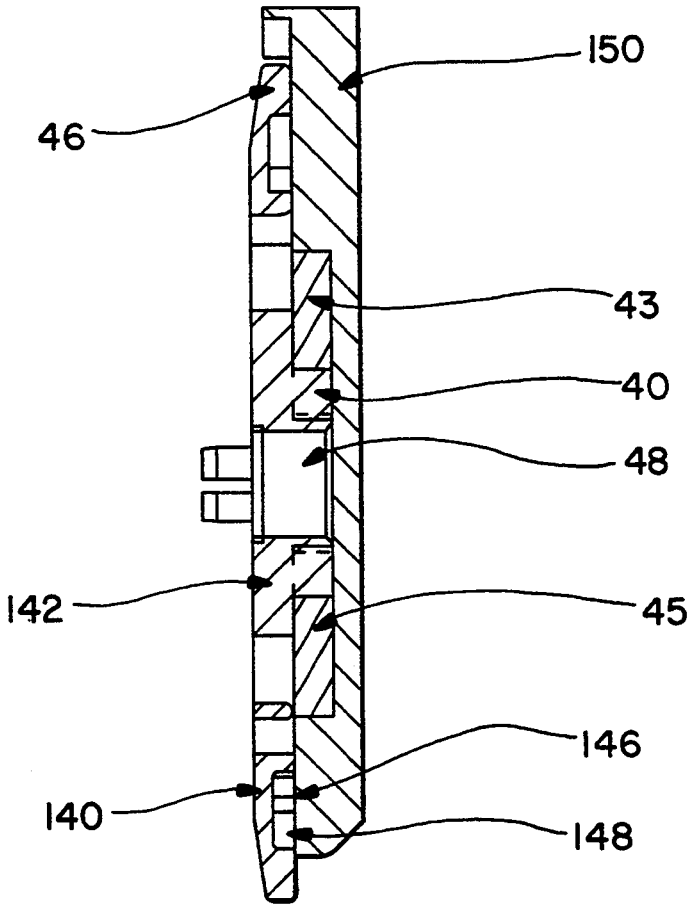
FIG. 9 is a cross-sectional view along the line 9—9 of FIG. 8.
Figure 10:
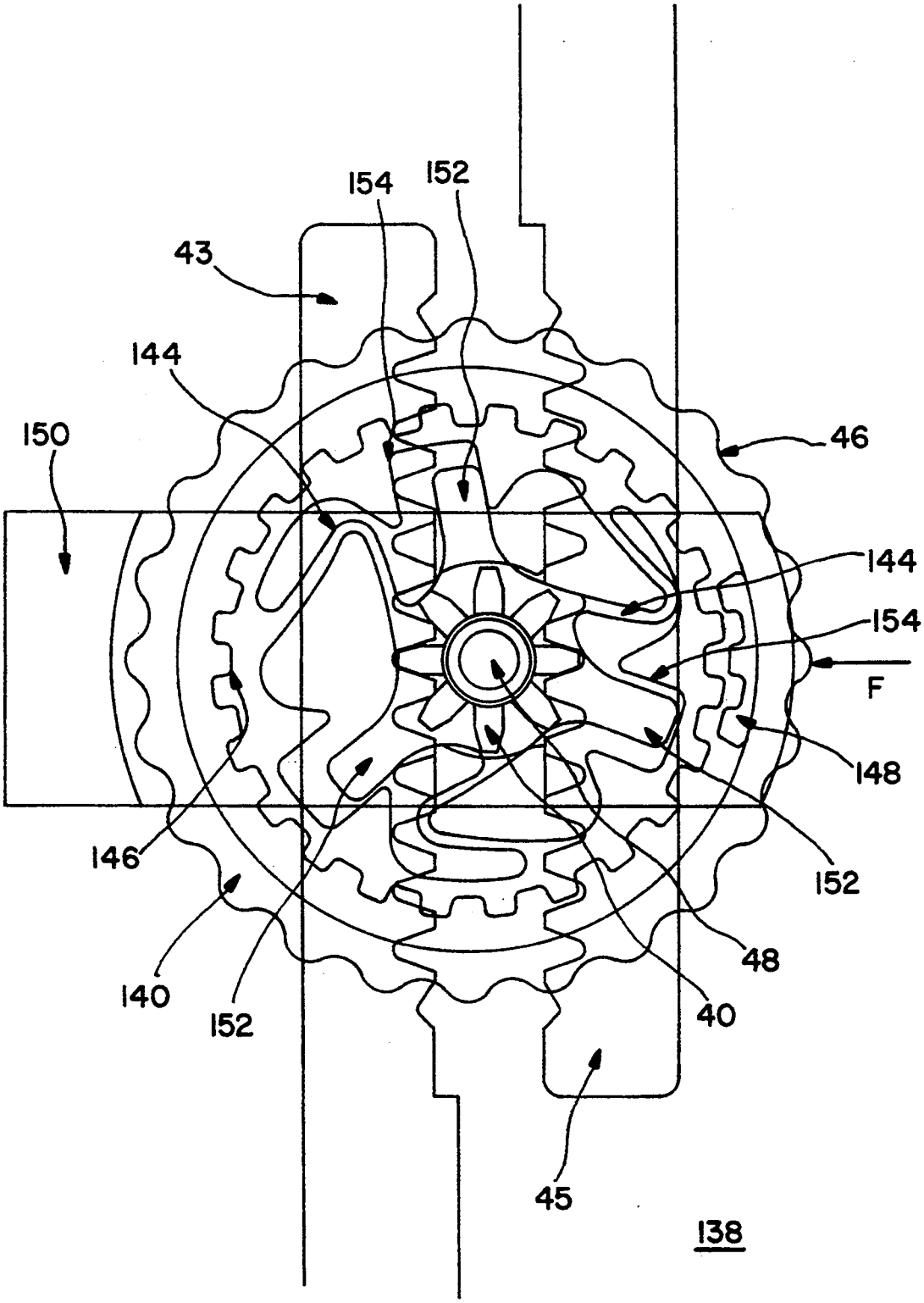
FIG. 10 is an identical view to FIG. 8 in the unlocked position of the adjustment mechanism.

In FIGS. 8–10, an improvement of the first adjustment mechanism 38 of FIG. 2 enables the double crown-wheel 42, 44 to be locked in a predetermined adjustment position. This improvement of the mechanism is designated by the general reference 138, and the same reference numbers will hereafter be used to designate identical or similar parts. The operating ring 46 of the mechanism 138 comprises a peripheral gripping portion 140 joined to an intermediate support portion 142 of the pinion 40 by flexible ribs 144. The gripping portion 140 is equipped on its internal surface with an annular toothing 146 designed to cooperate with a toothed stop 148 securedly united to the guide 150 housing the two ends 43, 45 of the head-band 32. The intermediate portion 142 is provided with several radial teeth 152 housed with clearance in conjugate drive notches 154 of the gripping portion 140.

In FIG. 9, the mechanism 138 is in a rest position, and the flexibility of the ribs 144 urges engagement of the toothing 146 of the ring 46 with the teeth of the fixed stop 148. Any forced rotation of the ring 46 around the spindle 48 is rendered impossible by the locking effect of the teething 146 by the stop 148. The pinion 40 remains immobilized, as do the two crown-wheels 42, 44 of the head-band 32.

To modify the length of the head-band 32, all that is required in a first phase is to exert a pressure on the ring 46 in the direction of the arrow F (FIG. 10) causing a locking effect due to the toothing 146 being released from the stop 148, and then in a second phase to turn the ring 46 in a predetermined direction to drive the teeth 152 and move the crown-wheels 42, 44. The unlocking force has to overcome the opposing flexible action of the ribs 144, and is maintained throughout the rotation of the ring 46. After the head-band 32 has been adjusted, the user releases the pressure on the ring 46, which automatically returns to the locked rest position in FIG. 9 due to the flexible return action of the ribs 144. In the presence of traction forces on the strip of the head-band 32, notably when an external shock occurs on the crown 12, the pinion 40 remains fixed due to the locking effect of the toothing 146.

We claim:

1. A safety helmet with a crown made of material resistant to mechanical shocks, containing a lining cap separated from the peak of the crown by an insulating gap, a securing device having a head-band composed of a flexible annular strip arranged away from the edge of the crown to grip the circumference of the user's head and a retaining strap neck-band having a fixed end, means for adjusting the length of the head-band comprising:

a first adjustment mechanism with a first operating inventor pinion cooperating simultaneously with a first crown-wheel and a second crown-wheel both having toothing located respectively at the two opposite ends of the strip, a first operating device accessible from outside and able to be grasped in the fitted position of the helmet on the user's head, said first operating device being in mechanical connection with the first operating invertor pinion, and being formed by a first rotatable ring comprising a first spindle on which the first operating invertor pinion is mounted, which is arranged to transform the rotation movement of the rotatable ring into two reverse sliding movements of the two crown-wheels resulting in an increase or decrease of the length of the head-band depending on the rotational direction of the ring, said first adjustment mechanisms and the two ends of the head-band being located in a middle zone on a lateral side between a back side and a front side of said crown, and the toothing of the two crown-wheels being identical to preserve centering of front and rear parts of the head-band when adjustment is performed by the first adjustment mechanism, and means for adjusting the length of the neck-band, said neck-band having an end opposite to said fixed end equipped with a third crown wheel cooperating with a second pinion of a second adjustment mechanism associated with a second operating device.

2. The safety helmet according to claim 1, including a first fixed flange and wherein the first spindle of the first rotatable ring is mounted for rotation in an orifice of said first fixed flange, in an appreciably perpendicular direction to a lateral side wall of the crown, and the first operating inverter pinion is located in a same plane with the first and second crown-wheels perpendicular to the spindle.

3. The safety helmet according to claim 2, including a guide cage to ensure positioning of the two crown-wheels on the teeth of the first operating inverter pinion, and wherein the first fixed flange is separated from an internal lateral wall of the crown by a first lateral space for housing the first adjustment mechanism, the two crown-wheels and first operating inverter pinion assembly being located between the first rotatable ring and the guide cage.

4. The safety helmet according to claim 1, including a flexible attachment united to the crown at a front part and rear part of the head-band and crown and wherein the flexibility of the attachment follows the movement of decreasing or increasing the size of the head-band when the first operating device is adjusted, while ensuring that the head-band is maintained at a predetermined level, each said flexible attachment comprising two staggered orifices, either one of which can be clipped onto a securing stud according to the required level of the head-band.

5. The safety helmet according to claim 1, wherein the first and second adjustment mechanisms are arranged respectively in first and second spaces on two opposite lateral sides near a mid-zone of the crown.

6. The safety helmet according to claim 5, wherein the second operating device is formed by a second rotatable ring with a second rotatable spindle engaged in an orifice of a second flange, the pinion is mounted coaxially on the second rotatable spindle, and a guide part securedly united to the head-band is housed in the second space to ensure positioning of the third crown-wheel on the pinion.

7. A safety helmet with a crown made of material resistant to mechanical shocks, containing a lining cap separated from the peak of the crown by an insulating gap, a securing device having a head-band composed of a flexible annular strip arranged away from the edge of the crown to grip the circumference of the user's head and means for adjusting the length of the head-band comprising:

a first adjustment mechanism with a first operating invertor pinion cooperating simultaneously with a first crown-wheel and a second crown-wheel both having toothing located respectively at the two opposite ends of the strip, a first operating device accessible from outside and able to be grasped in the fitted position of the helmet of the user's head, said first operating device being in mechanical connection with the first operating invertor pinion, and being formed by a first rotatable ring comprising a first spindle on which the first operating invertor pinion is mounted, which is arranged to transform the rotation movement of the rotatable ring into two reverse sliding movements of the two crown-wheels resulting in an increase or decrease of the length of the head-band depending on the rotational direction of the ring, said first adjustment mechanism and the two ends of the head-band being located in a middle zone on a lateral side between a back side and a front side of said crown, and the toothing of the two crown-wheels being identical to preserve centering of front and rear parts of the head-band when adjustment is performed by the first adjustment mechanism, said first rotatable ring comprising:

a first gripping portion equipped with an annular toothing designed to cooperate with a toothed stop securedly united to a fixed guide housing the two ends of the head-band, a second support portion of the first operating invertor pinion, which is joined to the first gripping portion by flexible ribs, and means for driving the first operating invertor pinion in rotation when rotation of the first rotatable ring takes place after the toothing has been unlocked.

8. The safety helmet according to claim 7, wherein the flexibility of the ribs urges engagement of the toothing of said first gripping portion with the teeth of the stop to lock the double crown-wheel in a predetermined adjustment position, and the unlocking effect is performed in the opposite direction by a manual action on the first rotatable ring resulting in the toothing being released from the stop.

* * * * *